US008611545B2

(12) United States Patent
Takashima

(10) Patent No.: US 8,611,545 B2
(45) Date of Patent: Dec. 17, 2013

(54) SURROUND GENERATION APPARATUS

(75) Inventor: Noriyuki Takashima, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 974 days.

(21) Appl. No.: 12/411,705

(22) Filed: Mar. 26, 2009

(65) Prior Publication Data

US 2009/0279706 A1 Nov. 12, 2009

(30) Foreign Application Priority Data

May 7, 2008 (JP) ..... 2008-120970

(51) Int. Cl.
*H04R 5/00* (2006.01)
*H04R 25/00* (2006.01)

(52) U.S. Cl.
USPC ..... 381/17; 381/18; 381/19; 381/20; 381/21; 381/22; 381/27

(58) Field of Classification Search
USPC ..... 381/17–22, 27
See application file for complete search history.

(56) References Cited

U.S. PATENT DOCUMENTS

| | | | | |
|---|---|---|---|---|
| 7,764,805 | B2 | 7/2010 | Tomita et al. | |
| 2005/0031128 | A1 * | 2/2005 | Tomita et al. | 381/18 |
| 2006/0013101 | A1 | 1/2006 | Kawana et al. | |
| 2006/0256969 | A1 | 11/2006 | Takashima et al. | |
| 2007/0019813 | A1 | 1/2007 | Hilpert et al. | |
| 2008/0226085 | A1 | 9/2008 | Takashima | |
| 2009/0252339 | A1 * | 10/2009 | Obata et al. | 381/18 |

FOREIGN PATENT DOCUMENTS

| | | | | |
|---|---|---|---|---|
| JP | 08-168100 | | 6/1996 | |
| JP | 2004-364238 | | 12/2004 | |
| JP | 2005-094271 | | 4/2005 | |
| JP | 3682032 | | 5/2005 | |
| JP | 2007-228033 | | 9/2007 | |
| JP | 2007-336118 | | 12/2007 | |
| JP | 2007-088568 | | 4/2008 | |
| WO | WO2007/034806 | * | 3/2007 | H04S 5/02 |

* cited by examiner

*Primary Examiner* — S. V. Clark
*Assistant Examiner* — Jesse Y Miyoshi
(74) *Attorney, Agent, or Firm* — Brinks Gilson & Lione

(57) ABSTRACT

A surround system includes a decoder that decodes an encoded audio data stream, a decorrelation unit that receives and decorrelates stereo signals decoded by the decoder so as to generate surround signals having a low-correlation component, an addition unit that adds high-correlation-component signals extracted from the stereo signals to the surround signals generated by the decorrelation unit, and a controller that controls addition of the high-correlation-component signals performed by the addition unit on the basis of the bit rate of the audio data stream.

14 Claims, 20 Drawing Sheets

FIG. 3

| BIT RATE | SL/SR RATIO | C(CL/CR) RATIO | DELAY AMOUNT |
|---|---|---|---|
| LOW | LOW | HIGH | LARGE |
| ↑ | ↑ | ↑ | ↑ |
| ↓ | ↓ | ↓ | ↓ |
| HIGH | HIGH | LOW | SMALL |

FIG 4

| CODING METHOD | STEREO CODING | JOINT STEREO CODING |
|---|---|---|
| C($C_L$ OR $C_R$) RATIO | HIGH | LOW OR ZERO |
| DELAY AMOUNT | LARGE | SMALL OR ZERO |

SURROUND GENERATION APPARATUS

RELATED APPLICATIONS

The present application claims priority to Japanese Patent Application Number 2008-120970, filed May 7, 2008, the entirety of which is hereby incorporated by reference.

BACKGROUND OF THE INVENTION

1. Field of the Invention

The present invention relates to a surround generation apparatus for generating a multi-channel surround signal from a two-channel stereo signal. In particular, the invention relates to a surround system for providing a favorable surround space inside a vehicle.

2. Description of the Related Art 5-ch or 5.1-ch surround systems for providing a sound field bringing a sense of realism or a surround effect in a home theater, an in-vehicle space, or the like have been widely used. Among such surround systems, relatively low-cost systems use a method for expanding a two-channel stereo signal into a multi-channel surround signal.

For example, Japanese Patent No. 3682032 discloses a technology for generating a surround signal from a two-channel stereo signal. FIG. 18 is a diagram showing a configuration of an adaptive decorrelation apparatus using a FIR filer described in Japanese Patent No. 3682032. The adaptive decorrelation apparatus includes a decorrelation filter that extracts, from an input signal X of a first channel, a signal component having a strong correlation with an input signal Y of a second channel by dividing the input signal X of the first channel by multi-stage delay processors $Z^{-1}$, superimposing predetermined coefficients on the outputs of the delay processors using coefficient processors $W_0$, $W_1$, . . . $W_k$, and summing up the outputs of these coefficient processors in an adder Σ. Also, the adaptive decorrelation apparatus includes a coefficient update processor 5 that changes a characteristic of the decorrelation filter with time on the basis of an error signal e obtained from an output signal RES of the decorrelation filter and the input signal Y of the second channel, the input signal X of the first channel, and a step-size parameter for controlling the update speed of the filter coefficient. A calculator 4 generates a surround signal from a difference between the output RES from the decorrelation filter and input signal Y of the second channel.

It is known that a cross-correlation coefficient is used as one of indexes numerically indicating a sense of expansion of a surround sound. Here, a cross-correlation coefficient will be observed using the correlation between two signals as an example.

Specifically, imagine a surround sound field as shown in FIG. 19. FIG. 19 is a drawing showing an example disposition of speakers in an in-vehicle surround space. Disposed at the left and right of the front seats are front speakers FL and FR for outputting stereo signals L and R. Disposed at the left and right of the rear seats are rear speakers RL and RR for outputting surround signals SL and SR. Disposed at the midpoint of the front seats is a speaker CT for outputting a center signal C. Also, disposed at the midpoint of the rear seats is a subwoofer (not shown) for outputting a bass signal LFE. Use of a surround system according to this embodiment allows providing improved surround sound quality inside the vehicle.

The cross-correlation coefficient between the FL and RR, which are diagonally-disposed speakers, is observed. Here, it is assumed that the cross-correlation coefficient is a numerical value in a range from −1 to 1 and that a cross-correlation coefficient "1" indicates that two signals are identical (identical phase) and a cross-correlation coefficient "0" indicates that the two signals have no relation (no correlation), and a cross-correlation coefficient "−1" indicates that the two signals have an opposite relation (opposite phase).

FIG. 20 is a graph showing a distribution of a cross-correlation coefficient shown when a piece of music is observed for approximately two minutes. The lateral axis represents the time (sec.) and the vertical axis represents the cross-correlation coefficient. In the distribution shown in FIG. 20, a-1 indicates the cross-correlation coefficient between received stereo signals L and R, and a-2 indicates the relation between the stereo signal L and an error signal eR of an ADF (adaptive filter), that is, the decorrelated surround signal SR. a-1 may also be considered as the cross-correlation coefficient between the original signals of the stereo signals L and R and may be used as a reference for comparison.

In FIG. 20, it is observed that the cross-correlation coefficient has been changed from 0.4 to 0 due also to the influence of the learning speed of the adaptive filter until about 10 seconds elapse. During a period from 10 to 30 seconds, a-1 indicates that the stereo signals L and R have a correlation of approximately 1, showing a high characteristic. On the other hand, during the same period, a-2 indicates that the cross-correlation coefficient has been approximately −0.3. That is, even if the original signals have a high correlation, the cross-correlation coefficient becomes a smaller value by performing decorrelation.

In this music, the correlation has been changed every 30 seconds. Specifically, during a period from 10 to 30 seconds, bass of an instrument has been dominant; during a period from 30 to 60 seconds, a chorus has been dominant, that is, there has been an expanding sound; during a period from 60 to 90 seconds, a vocal has been dominant; and during a period of 90 seconds and later, there has been an interaction between a vocal and a chorus, that is, the cross-correlation coefficient has significantly varied.

During a period of 30 seconds and later, the cross-correlation coefficient of a-2 has been around zero in contrast to the correlation change showed by a-1, although a slight variation is observed. That is, if surround signals SL and SR are generated from stereo signals using the technology disclosed in Japanese Patent No. 3682032, the surround signal SL and SR having a low-correlation component can be extracted stably. Also, in terms of surround, the fact that the cross-correlation coefficient has been around zero favorably indicates that a sense of expansion is always kept at the maximum in a playback sound field.

Audio coding schemes such as MP3 (MPEG-1) and AAC (MPEG-2/4) each have the stereo method and joint stereo method. A significant difference between the two methods is whether components having a high correlation, of the stereo signals L and R are considered. Specifically, in the stereo coding, the stereo signals L and R are coded in a compressed manner independently. On the other hand, in the joint stereo coding, components having a high correlation, of the stereo signals L and R are extracted and then coded in a compressed manner as joint signals. As for the stereo coding, a sense of expansion is obtained, since the signals L and R are coded in a compressed manner independently. However, the independence between the channels is increased. Therefore, there are pieces of music where the signals L and R cannot match each other's correlation change.

In such a background, there is a problem that if a decorrelation process as shown in FIG. 18 is performed after an encoded audio signal is decoded by a playback apparatus, an extracted surround signal having a low-correlation component is significantly influenced by compression caused by coding and thus becomes a distorted signal or a signal including many artifacts (artificial sounds) and having poor sound quality.

FIG. 21 is a graph showing a frequency characteristic of a surround signal having a low-correlation component extracted in the decorrelation process shown in FIG. 18. This graph is obtained by averaging data having an FFT (fast-Fourier-transform) length of 1024 points 32 times (at a sampling frequency of 44.1 kHz or 743 ms for time) with respect to each of the signals from a location of 10 seconds during a period from 10 to 30 seconds shown in FIG. 20 in an area where artifacts are particularly characteristic, performing an FFT process, and then plotting the data. In FIG. 21, b-1 shows a characteristic of a surround signal having a linear PCM signal as an input. b-2 shows a characteristic of a surround signal using a signal coded using MP3 format and the joint stereo method and having a bit rate of 128 kbps as an input. b-3 shows a characteristic of a surround signal having a signal coded using MP3 format and the stereo method and having a bit rate of 128 kbps as an input.

Pay attention to a frequency range of 200 Hz to 1 kHz including a large amount of music information. From FIG. 21, it is understood that b-2 using the joint stereo method maintains a characteristic very similar to a characteristic of a non-compression linear PCM shown by b-1. On the other hand, deviations are observed in b-3 using the stereo method compared with a linear PCM shown by b-1 and it can be concluded that these deviations are artifacts caused by compression.

FIG. 22 shows a comparison between a result of a surround algorithm based on stereo signals L-R and R-L and the stereo method. The lateral axis represents the frequency and the vertical axis represents the amplitude (dB). The observation periods are the same as those shown in FIG. 21. In FIG. 22, c-1 shows a characteristic of a surround signal that has, as an input, a signal coded using MP3 format and the stereo method and having a bit rate of 128 kbps and that has undergone the decorrelation process shown in FIG. 18. c-2 shows a characteristic of a surround signal that has, as an input, a signal coded using MP3 format and the stereo coding and having a bit rate of 128 kbps and that has undergone a process of a stereo signal L-R. For convenience, an HPF having a cutoff frequency of 200 Hz is used in c-1. Therefore, if c-1 and c-2 are compared except for low frequencies thereof, they have similar characteristics. Accordingly, even if the surround algorithm based on the L-R and R-L is used, artifacts caused by compression-coding are remarkable as well. As described in Japanese Patent No. 3682032, the decorrelation method shown in FIG. 18 is better as a surround algorithm; however, artifacts caused by compression remain.

Also, the existence of artifacts will be examined from another point of view. Specifically, an increase or a reduction in the number of artifacts made by changing the bit rate for compression will be observed. FIG. 23 is a graph showing a frequency characteristic of a surround signal having a low-correlation component extracted in the decorrelation process shown in FIG. 18. The observation periods are the same as those shown in FIG. 21. In FIG. 23, d-1 shows a characteristic of a surround signal having a linear PCM signal as an input (same as b-1 shown in FIG. 21). d-2 shows a characteristic of a surround signal having, as an input, a signal coded using AAC format the stereo coding and having a bit rate of 256 kbps. d-3 shows a characteristic of a surround signal having, as an input, a signal using AAC format and the stereo coding and having a bit rate of 128 kbps.

Pay attention to a frequency range of 200 Hz to 1 kHz including a large amount of music information. From FIG. 23, it is understood that d-2 and d-3 have more deviations than d-1, since d-2 and d-3 use the stereo method. Observe the graph more precisely. No significant difference can be seen between the bit rates in a range from 200 to 500 Hz. On the other hand, it is understood that the surround signal having the higher bit rate is closer to d-1 in a range from 500 Hz to 1 kHz.

SUMMARY OF THE INVENTION

An advantage of the present embodiments is to provide a surround generation apparatus that is allowed to generate a stable surround sound field having fewer distorted signals and offering a sense of expansion even from a compressed audio signal.

A first aspect of the present embodiments provides a surround generation apparatus for generating a multi-channel surround signal from a stereo signal. The surround generation apparatus includes: a decoder for decoding an encoded audio signal; a decorrelation unit for receiving a stereo signal decoded by the decoder and decorrelating the stereo signal so as to generate a surround signal having a low-correlation component; an addition unit for adding, to the surround signal, a high-correlation-component signal extracted from the stereo signal; and a controller for controlling addition of the high-correlation-component signal performed by the addition unit on the basis of information about coding of the audio signal obtained from the decoder.

The decorrelation unit preferably extracts, from a first stereo signal, a high-correlation-component signal having a high correlation with a second stereo signal and generates a surround signal having a low-correlation component from a difference between the extracted high-correlation-component signal and the second stereo signal, and the addition unit preferably adds the high-correlation-component signal extracted by the decorrelation unit to the surround signal. The addition unit may add a high-correlation-component signal C including the high-correlation-component signal CL and the high-correlation-component signal CR to each of the surround signal SL and the surround signal SR.

When a coding bit rate of the stereo signal, the coding bit rate being used as the coding information, is a first bit rate, the controller preferably controls the addition unit so that the high-correlation-component signal is added at a first rate, and when the coding bit rate is a second bit rate higher than the first bit rate, the controller controls the addition unit so that the high-correlation-component signal is added at a second rate lower than the first rate. When a coding method of the stereo signal, the coding method being used as the coding information, is a first coding method, the controller preferably controls the addition unit so that the high-correlation-component signal is added at a first rate, and when the coding method is a second coding method, the controller controls the addition unit so that the high-correlation-component signal is added at a second rate lower than the first rate.

The addition unit preferably adds, to the surround signal, a signal obtained by eliminating a low-frequency component from the high-correlation-component signal. The addition unit preferably includes a high-pass filter for eliminating a low-frequency component having a frequency equal to or lower than a predetermined frequency. The surround generation apparatus preferably further includes a delay circuit for delaying the surround signal. The controller preferably controls a delay made by the delay circuit on the basis of the coding information. When a coding bit rate of the stereo signal, the coding bit rate being used as the coding information, is a first bit rate, the controller preferably controls the delay circuit so that the surround signal is delayed by a first delay amount, and when the coding bit rate is a second bit rate higher than the first bit rate, the controller preferably controls the delay circuit so that the surround signal is delayed by a second delay amount smaller than the first delay amount.

A second aspect of the present embodiments provides a surround generation method for generating a multi-channel surround signal from a stereo signal. The method includes: decoding an encoded audio data stream; receiving a decoded stereo signal, extracting, from a first stereo signal, a high-correlation-component signal having a high correlation with a second stereo signal, and generating a surround signal having a low-correlation component from a difference between the extracted high-correlation-component signal and the second stereo signal; adding the extracted high-correlation-component signal to the surround signal on the basis of a bit rate of the coded audio data stream; and delaying the added surround signal on the basis of the bit rate.

In a preferred aspect of the present embodiments, a decoded, compressed audio signal is passed through a decorrelation filter so that a high-correlation component and a low-correlation component are separated once. Then, the low-correlation component is mixed with the high-correlation component having a low ratio. Here, pay attention to the bit rate. Then, the mixing ratio of the high-correlation component is changed in accordance with the bit rate. If the bit rate is low, a sub-band to be used may be selected. This will increase the width of sound quality degradation. As a method, as the bit rate is lowered, the mixing ratio of the high-correlation component is increased, and as the bit rate is increased, the mixing ratio of the low-correlation component is increased. If the bit rate is low, the mixing ratio of the high-correlation component is increased; therefore, a sense of expansion will be reduced slightly. For this reason, it is preferable to add a delay to reduce the cross-correlation coefficient value. If the bit rate is lowered, it is preferable to increase the delay.

By adopting the aspects of the present embodiments, when generating a surround signal from an encoded stereo signal, a high-correlation component of the stereo signal is added to a surround signal having a low-correlation component on the basis of information about the coding of the stereo signal. Thus, a surround signal that is less influenced by compression caused by coding and whose sound quality is improved is obtained. Also, a reduction in a sense of expansion caused by adding the high-correlation component is compensated for by delaying the surround signal. Thus, a stable sense of expansion is obtained.

BRIEF DESCRIPTION OF THE DRAWINGS

FIG. 3 is a table showing the relations between a bit rate, and the addition ratio of a high-correlation-component signal and a delay amount;

FIG. 4 is a table showing the relations between a coding method, and the addition ratio of a high-correlation-component signal and a delay amount;

DESCRIPTION OF THE PREFERRED EMBODIMENT

An embodiment of the present invention will be described with reference to the accompanying drawings. Hereafter, a vehicle-mounted surround system will be used as a preferred example of a surround playback apparatus.

Embodiment

Figure 1:
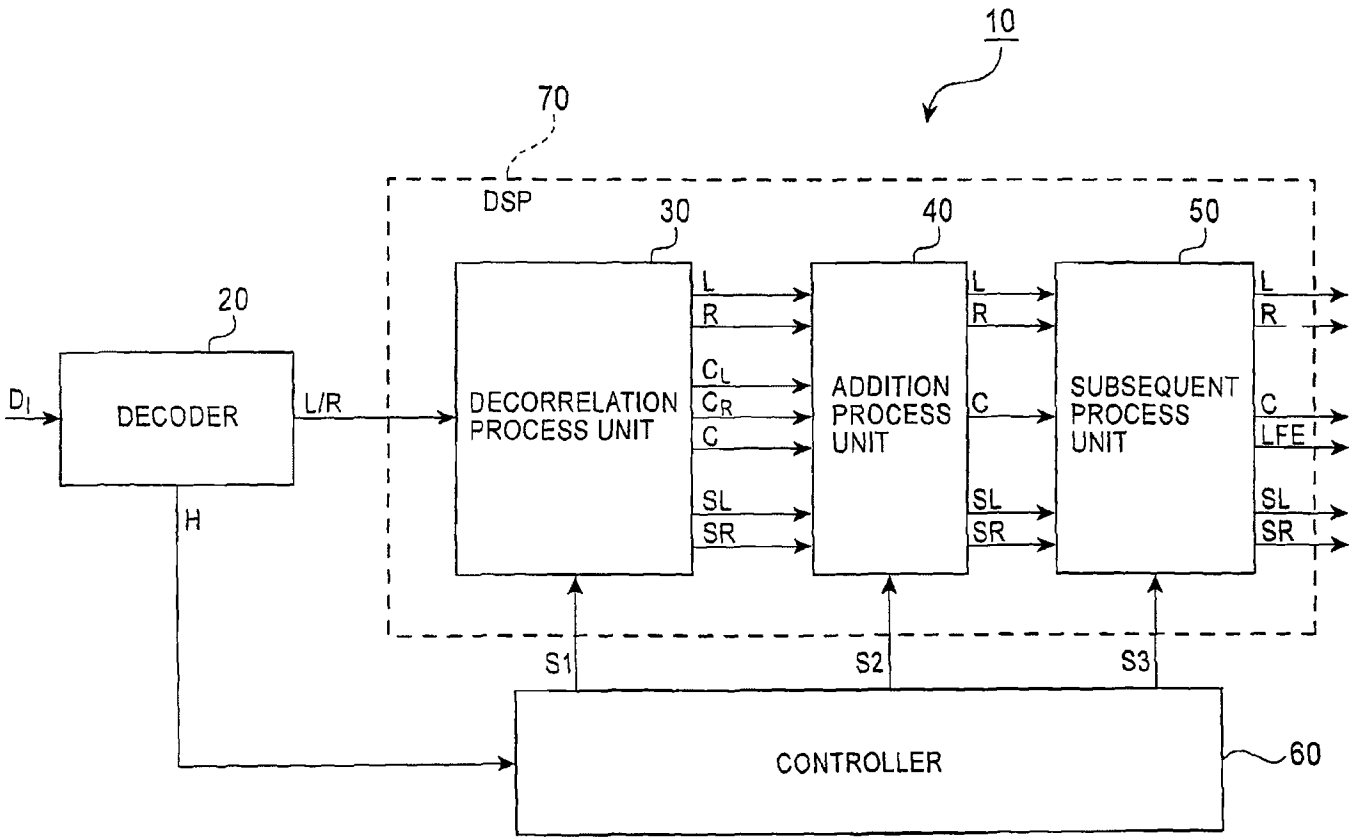
FIG. 1 is a schematic diagram of a surround system according to an embodiment of the present embodiments.

FIG. 1 is a schematic diagram of a vehicle-mounted surround system according to this embodiment. A surround system 1 includes a decoder 20 that receives and decodes an audio data stream D1 encoded in a compressed manner, a decorrelation unit 30 that receives and decorrelates stereo signals L and R decoded by the decoder 20 so as to generate decorrelated surround signals SL and SR having a low-correlation component, or the like, an addition unit 40 that adds a high-correlation-component signal to the surround signals SL and SR sent from the decorrelation unit 30, a subsequent processing unit 50 that performs processes such as equalizer, time correction, and crossover on a signal sent from the addition unit 40, and a controller 60 that controls the elements on the basis of coding information H of the audio data stream D1 obtained from the decoder 20.

The audio data stream D1 is, for example, an encoded, compressed audio signal received by a terrestrial television receiver or a radio receiver or a coded, compressed audio signal recorded in a compact disc (CD), a digital versatile disc (DVD), a Blu-ray disc, or a hard disk. The decoder 20 may be included in a television receiver, a radio receiver, or an audio playback apparatus. In this case, the audio data stream D1 is decoded in such an apparatus.

The decoder 20 decodes the audio data stream D1 to extract a stereo signal as well as extract the coding information H of the audio data stream D1. The coding information H includes information indicating the coding method, bit rate, or the like of the audio data stream D1. Use of the information indicating the coding method allows determining whether the audio data is encoded using the stereo method or joint stereo method and whether the audio data is MP3 data or AAC data. The stereo signals L and R decoded by the decoder 20 are provided to the decorrelation unit 30. The coding information H is provided to the controller 60.

The controller 60 generates control signals S1, S2, and S3 for controlling the decorrelation unit 30, addition unit 40, and subsequent processing unit 50, respectively, to the elements the corresponding elements, on the basis of the coding information H. In a preferred mode of this embodiment, the controller 60 controls a process such as addition of a high-correlation-component signal performed by the addition unit 40, in accordance with the bit rate of the audio data stream $D_1$. Also, the controller 60 controls a process such as addition performed by the addition unit 40, on the basis of whether the audio data stream $D_1$ is encoded using the stereo method or joint stereo method.

The decorrelation unit 30 receives and decorrelates the stereo signals L and R, generates high-correlation-component signals C, $C_L$, and $C_R$ having a high-correlation component and surround signals SL and SR having a low-correlation component, and sends these signals to the addition unit 40. Also, the decorrelation unit 30 delays the stereo signals L and R and sends these signals to the addition unit 40.

As will be described in detail, the addition unit 40 adds the high-correlation-component signals C, $C_L$, and $C_R$ to the surround signals SL and SR at a mixing ratio corresponding to the bit rate on the basis of the control signal S2 from the controller 60. The subsequent processing unit 50 processes signals sent from the addition unit 40 and generates the stereo signals L and R, the surround signals SL and SR, a center signal C, and a low-frequency signal LFE to amplifiers and speakers.

In this embodiment, the decorrelation unit 30, addition unit 40, and subsequent processing unit 50 are realized by a DSP (digital signal processor) 70 for audio processing. However, this is illustrative only and does not prevent the DSP from realizing the decoder 20 or controller 60, nor preventing other devices from realizing the decorrelation unit 30 or addition unit 40.

Figure 2:
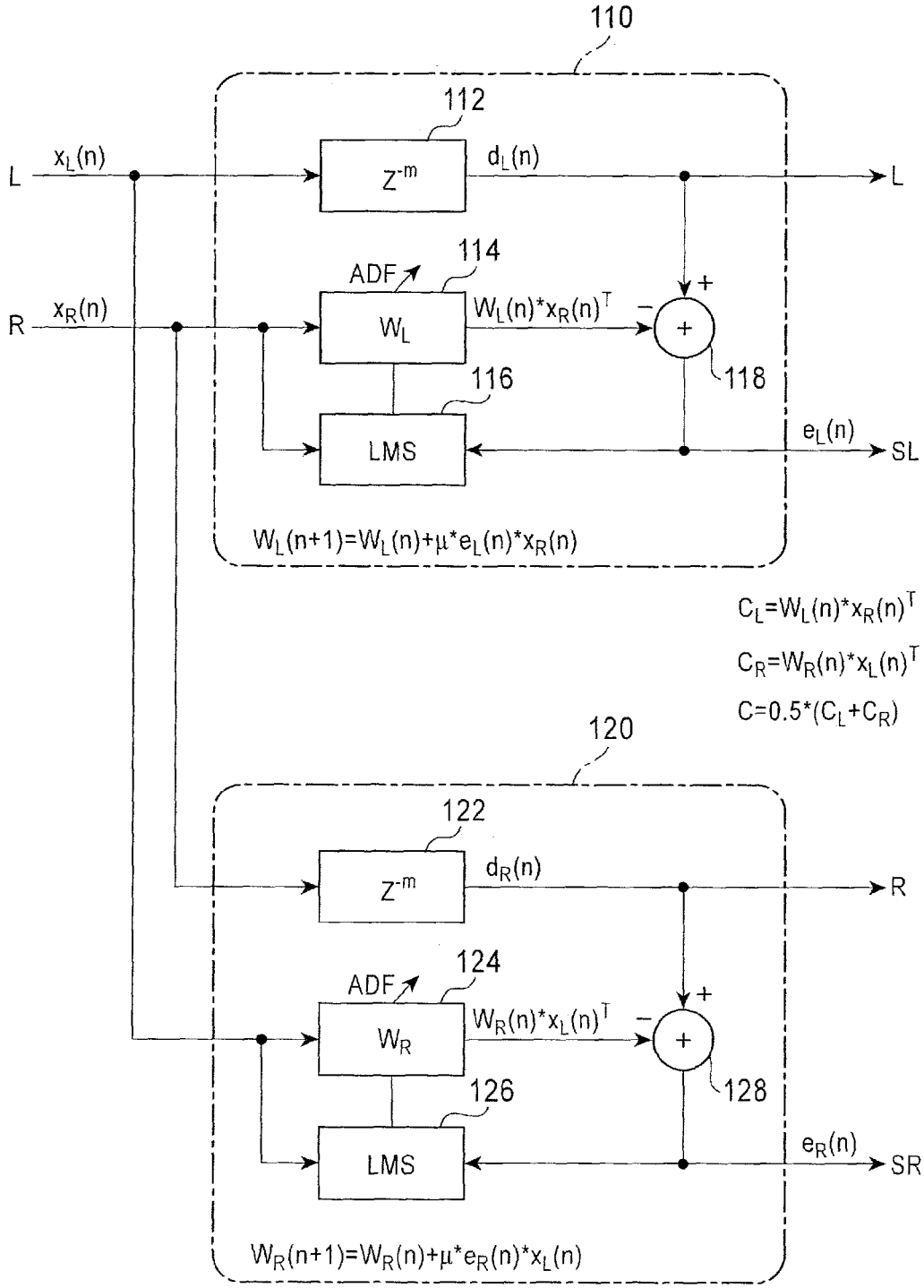
FIG. 2 is a block diagram showing a configuration of a decorrelation unit according to this embodiment.

FIG. 2 is a block diagram showing a configuration of the decorrelation unit 30 according to this embodiment. The decorrelation unit 30 performs a surround algorithm for expanding the two-channel stereo signals L and R into five-channel surround signals. Also, the stereo signals L and R each include a signal encoded using the stereo method or joint stereo method, down mix Lt/Rt and Lo/Ro, and the like. The stereo signals L and R are processed by the decorrelation unit 30 so that the stereo signals are separated into the signal C having the highest correlation, signals L and R having a high correlation, and signals SL and SR having a low correlation. The signal C having the highest correlation extracts a vocal in music; it extracts lines in a movie. A distorted sound or an artifact, which is a problem, appears in the signal SL and SR having a low correlation.

The decorrelation unit 30 includes a surround signal SL generation unit 110 for generating the surround signal SL and a surround signal SR generation unit 120 for generating the surround signal SR. The surround signal SL generation unit 110 includes a delay circuit 112 that has the configuration of the FIR filter shown in FIG. 18 and delays the stereo signal L and sends the delayed stereo signal L, an adaptive digital filter (ADF) 114 that extracts, from the stereo signal R, the high-correlation-component signal $C_L$ having a high correlation with the stereo signal L and sends the extracted signal, an LMS (coefficient calculation unit) 116 that calculates a filter coefficient of the ADF 114 using an LMS (least mean square) algorithm, and a difference circuit 118 that obtains a difference between the output of the delay circuit 112 and the high-correlation-component signal $C_L$ sent from the ADF 114, generates the surround signal SL from the obtained difference, and produces the generated surround signal SL.

Figure 18:
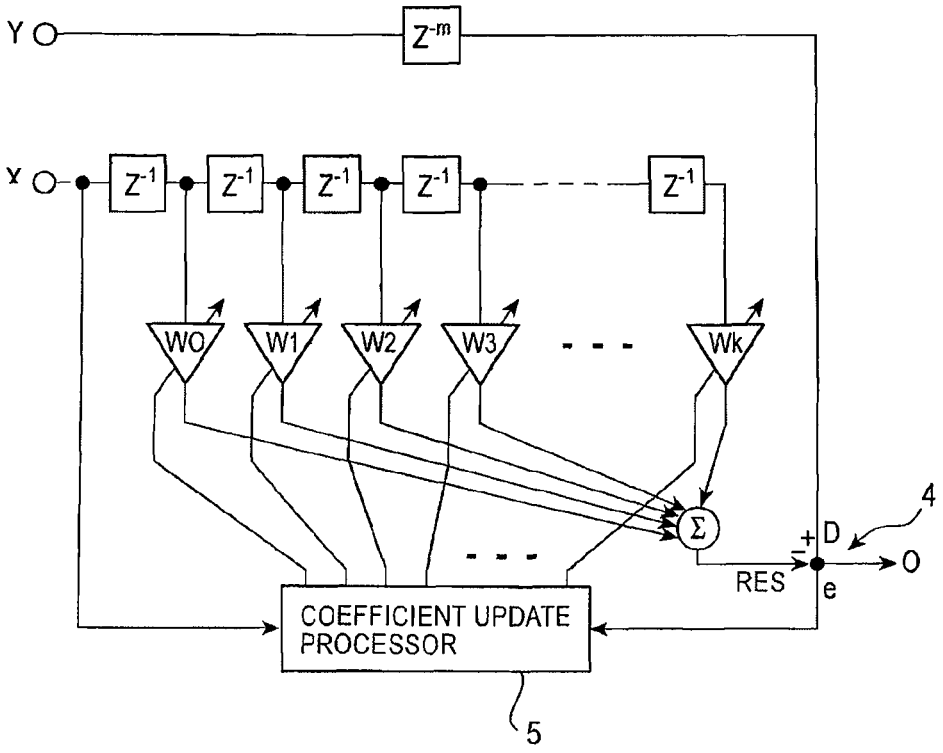
FIG. 18 is a diagram showing an example configuration of an adaptive decorrelation apparatus using a related-art FIR filer.
Figure 19:
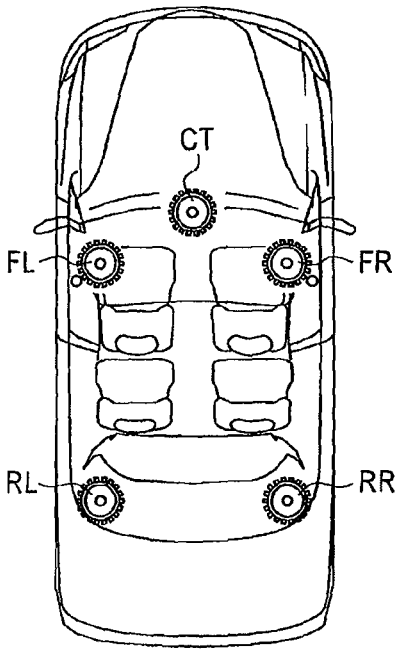
FIG. 19 is a drawing showing an example disposition of speakers in an in-vehicle surround space.

Likewise, the surround signal SR generation unit 120 includes a delay circuit 122 that has the configuration of the FIR filter shown in FIG. 18 and delays the stereo signal R and generates the delayed stereo signal R, an adaptive digital filter (ADF) 124 that extracts, from the stereo signal L, the high-correlation-component signal $C_R$ having a high correlation with the stereo signal R and the generates the extracted signal, an LMS (coefficient calculation unit) 126 that calculates a filter coefficient of the ADF 124 using an LMS (least mean square) algorithm, and a difference circuit 128 that obtains a difference between the output of the delay circuit 122 and the high-correlation-component signal $C_R$ sent from the ADF 124, generates the surround signal SR from the obtained difference, and produces the generated surround signal SR.

The ADF 114 of the surround signal SL generation unit 110 and the ADF 124 of the surround signal SR generation unit 120 each update an coefficient W thereof, e.g., in each sample (e.g., 1/44100 sec. for a sampling frequency of 44.1 kHz). The formulas for updating the coefficients of the ADF 114 and ADF 124 are as follows.

$$W_L(n+1)=W_L(n)+\mu\cdot e_L(n)\cdot X_R(n)$$

$$W_R(n+1)=W_R(n)+\mu\cdot e_R(n)\cdot X_L(n)$$

In these formulas, W represents a coefficient of the ADF, μ represents a step-size parameter ($0\leq\mu\leq1$), e(n) represents an error signal (=surround signal SL or SR), and $X_L(n)$ and $x_R(n)$ represent input signals.

The high-correlation-component signals CL, CR, and C are represented by the following formulas. In the formula below, T indicates inversion. While the coefficient of the C is conventionally set to 0.5, it may vary depending on the tuning.

$$C_L = W_L(n) \cdot X_R(n)^T$$

$$C_R = W_R(n) \cdot X_L(n)^T$$

$$C = 0.5 \cdot (C_L + C_R)$$

From these formulas, it is understood that the high-correlation-component signal C is a balanced signal because the high-correlation-component signal C is the sum of the high-correlation-component signals CL and CR that have passed through the ADF 114 and ADF 124, respectively, and because $SL = L - C_L$ and $SR = R - C_R$. It is necessary to have a function of preventing occurrence of artifacts as much as possible while maintaining a feeling of expansion to some extent. If the interchangeability between the signals is taken into account, it is preferable to have a function of remixing the once-separated surround signals SL and SR with the high-correlation-component signal C or high-correlation-component signals $C_L$ and $C_R$.

The roughness of artifacts becomes more remarkable as the bit rate is lowered. Therefore, the controller 60 controls the addition unit 40 so that the mixing ratio of the high-correlation-component signal C (or high-correlation-component signals $C_L$ and $C_R$) is increased, on the basis of the bit rate included in the coding information H, as described above. Here, a sense of expansion of the surround signals SL and SR may be lost due to the mixing of the high-correlation-component signal. Therefore, immediately after the surround signals SL and SR are mixed with the high-correlation-component signals, delays may be given to these surround signals so that the correlation coefficient is set to a lower value. It is desirable to set the mixing ratio and delay amount in accordance with an intended, approximately average cross-correlation coefficient (e.g., between 0 and 0.2).

FIG. 3 is a table showing the relations between the bit rate, and the addition ratio of the high-correlation-component signal C (or high-correlation-component signals $C_L$ and $C_R$) and delay amount. As shown, the mixing ratio of the high-correlation components is changed in accordance with the bit rate, which is an important parameter of compressed audio. As the bit rate is lowered, the mixing ratio of the high-correlation-component signal C (or high-correlation-component signals $C_L$ and $C_R$) is increased. As the bit rate is increased, the mixing ratio of low-correlation components in each of the surround signals SL and SR is increased. If the bit rate is low, the mixing ratio of the high-correlation components is increased so that a sense of expansion is reduced slightly. Therefore, in order to compensate for this reduction, the delay amount of the surround signal is increased. In contrast, if the bit rate is high, a sense of expansion is reduced to a lesser extent. Therefore, the delay amount is reduced.

Typically, the audio data stream $D_1$ is coded in accordance with the performance of the playback apparatus. As for the bit rate, there are a variety of bit rates, for example, 24 kbps, 48 kbps, 64 kbps, 96 kbps, 128 kbps, 160 kbps, 196 kbps, 256 kbps, 320 kbps, . . . , etc. The controller 60 predetermines the mixing ratios of the high-correlation-component signals and delay amounts corresponding to such a variety of bit rates, lists the predetermined mixing ratios and delay amounts in a table, and stores this table in a memory. Subsequently, the controller 60 refers to a bit rate obtained from the decoder 20, reads a mixing ratio and a delay amount corresponding to the bit rate from the table, and sends the read mixing ratio and delay amount to the addition unit 40. The mixing ratio and delay amount do not always need to correspond to the bit rates one-to-one and may be determined for each of given ranges including bit rates.

The controller 60 does not always need to use a table as described above. The controller 60 may include a predetermined threshold value and compare the threshold value with a bit rate so as to determine the size of the bit rate. Also, the number of threshold values is not always limited to one and multiple threshold values may be used to determine the size of the bit rate.

Also, in addition to the bit rate, the controller 60 may change the mixing ratio of the high-correlation-component signal C (or high-correlation-component signals $C_L$ and $C_R$) in accordance with the coding method of the audio data stream $D_1$. FIG. 4 is a table showing the relation between the coding method and mixing ratio. As shown, if the audio data stream $D_1$ is encoded using the stereo method, the controller 60 makes larger the addition ratio of the high-correlation-component signal and the delay amount than those in a case where the joint stereo method is used, since the surround signals are significantly influenced by compression. On the other hand, if the audio data stream $D_1$ is coded using the joint stereo method, the controller 60 may reduce the addition ratio of the high-correlation-component signal and the delay amount or may perform no such process.

Figure 5:
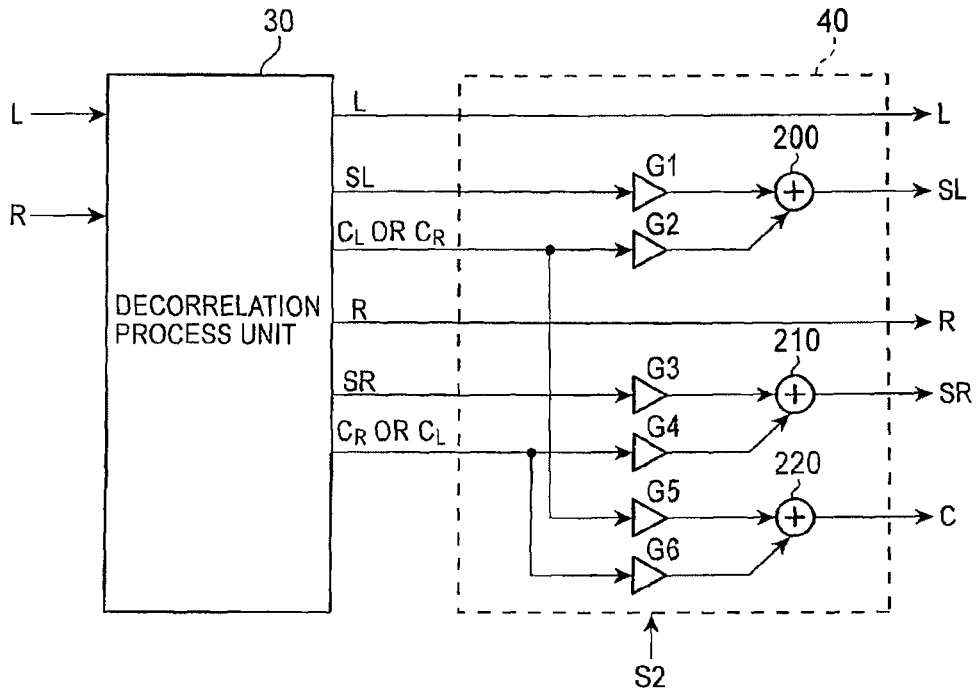
FIG. 5 is a diagram showing a first preferred example of an addition unit according to this embodiment.

Next, a configuration of the addition unit will be described in detailed. FIG. 5 is a diagram showing a first preferred example of the addition unit. The addition unit 40 shown in FIG. 5 remixes the high-correlation-component signals $C_L$ and $C_R$ and surround signals SL and SR, which have been separated once by the decorrelation unit 30, at a predetermined mixing ratio. The addition unit 40 includes amplifiers G1, G2, G3, G4, G5, and G6 for controlling the gains of the surround signal SL, high-correlation-component signal $C_L$, surround signal SR, and high-correlation-component signal $C_R$ generated from the correlation elimination process unit 30, and adders 200, 210, and 220. The amplifiers G1, G2, G3, and G4 control the gains of the high-correlation-component signals in accordance with the algorithm as shown in FIG. 3 or 4 on the basis of the control signal S2. The amplifiers G5 and G6 control the gains so that the mixing ratio of the high-correlation-component signal $C_L$ and that of the high-correlation-component signal $C_R$ are equalized.

The adder 200 adds the high-correlation-component signal $C_L$ to the surround signal SL and generates the resultant surround signals SL. The adder 210 adds the high-correlation-component signal $C_R$ to the surround signal SR and generates the resultant surround signals SR. The adder 220 mixes the high-correlation-component signal $C_L$ and high-correlation-component signal $C_R$ so as to generate a center signal C and produces the generated center signal C ($C = 0.5 \times (C_L + C_R)$).

The high-correlation-component signal $C_L$ is a high-correlation-component signal extracted from the stereo signal R and having a high correlation with the stereo signal L. Therefore, the high-correlation-component signal $C_L$ is highly dependent on the stereo signal R regardless of its designation including a subscript L. As such, the high-correlation-component signal $C_R$ is highly dependent on the stereo signal L.

Therefore, although the surround signal SL has a configuration of $SL \cdot G1 + C_L \cdot G2$ and the surround signal SR has a configuration of $SR \cdot G3 + C_R \cdot G4$ in FIG. 5, the high-correlation-component signal $C_R$ may be added to the surround signal SL if the high-correlation-component signal has been favorably extracted, considering that the surround signal SL is using the stereo signal L as its axis. As such, the high-correlation-component signal CL may be added to the surround signal SR. That is, the surround signal SL may have a configuration of $SL \cdot G1 + C_R \cdot G2$ and the surround signal SR has a configuration of $SR \cdot G3 + C_L \cdot G4$.

Figure 6:
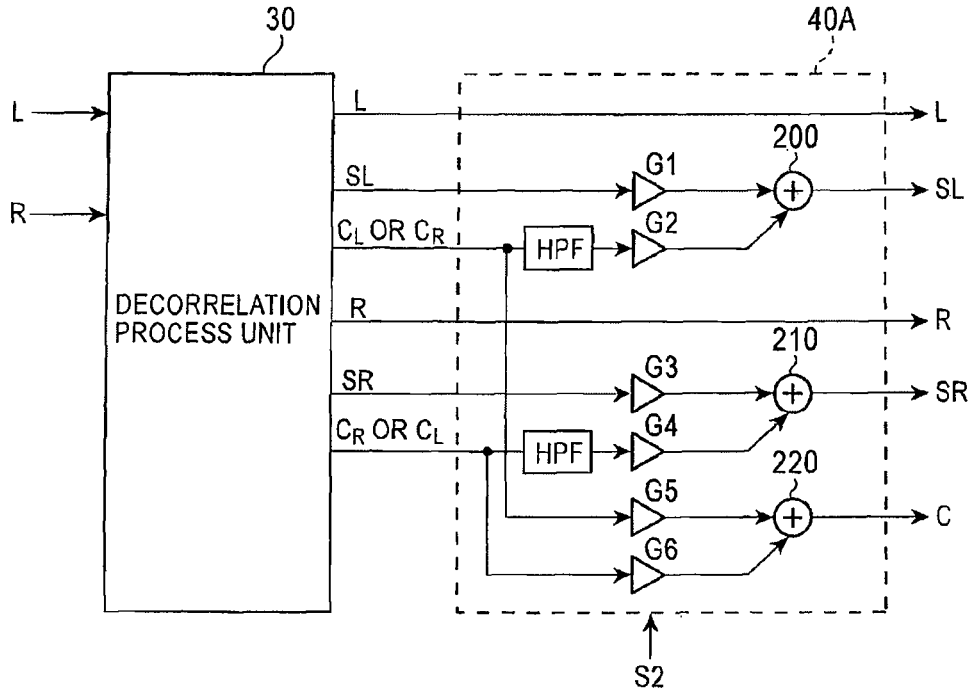
FIG. 6 is a second preferred example of the addition unit according to this embodiment.

FIG. 6 is a second preferred example of the addition unit. Unlike the first preferred example, an addition unit 40A according to the second preferred example is provided with high-pass filters (HPFs) for eliminating low-frequency components from the high-correlation-component signals $C_L$ and $C_R$. The high-correlation-component signals $C_L$ and $C_R$ are signals having a high-correlation component and often include low frequencies. As shown in FIG. 6, in order to obtain a sense of expansion of a surround sound field, unnecessary low frequencies are eliminated using the HPFs and then remixing is performed. The high-pass filer HPF is preferably allowed to set the cutoff frequency to around 200 Hz.

While the HPFs are additionally provided in the example shown in FIG. 6, the high-correlation-component signals $C_L$ and $C_R$ that have been passed through only a frequency range where most artifacts exist may be added to the corresponding surround signals. In this case, the high-pass filters (HPFs) may be replaced with band-pass filers (BPFs).

Figure 7:
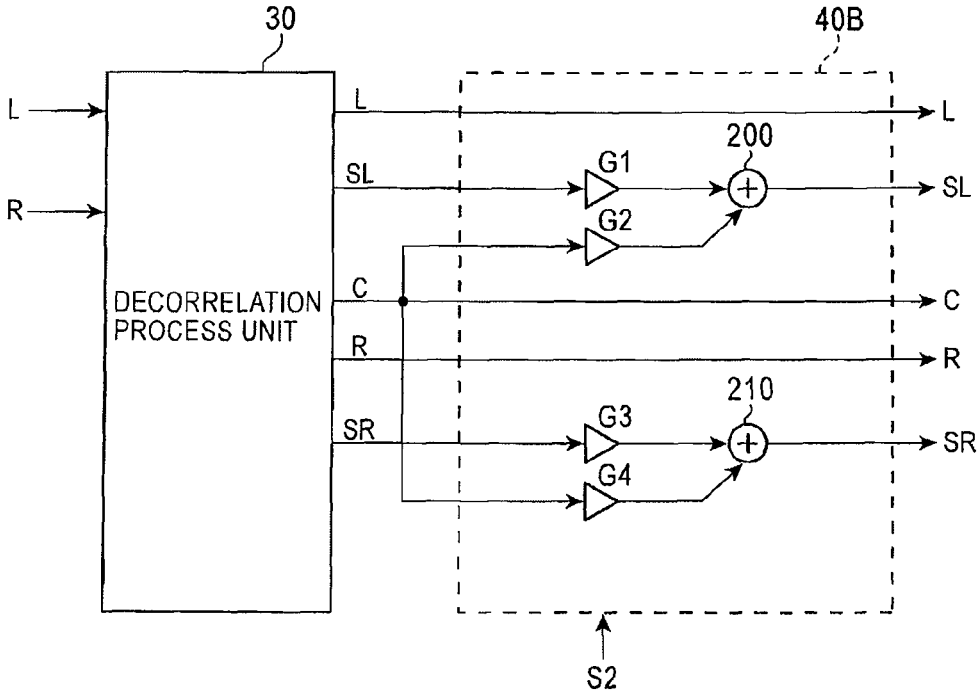
FIG. 7 is a third preferred example of the addition unit according to this embodiment.

FIG. 7 is a third preferred example of the addition unit. An addition unit 40B mixes each of the surround signals SL and SR with a high-correlation-component signal C ($C=0.5\times(C_L+C_R)$). Specifically, a high-correlation-component signal C passed through the amplifier G2 is added to the surround signal SL by the adder 200. Also, a high-correlation-component signal C passed through the amplifier G4 is added to the surround signal SR by the adder 210. By adopting the third preferred example, for example, an audio signal coded using the stereo method can be made similar to a signal coded using the joint stereo method.

Figure 8:
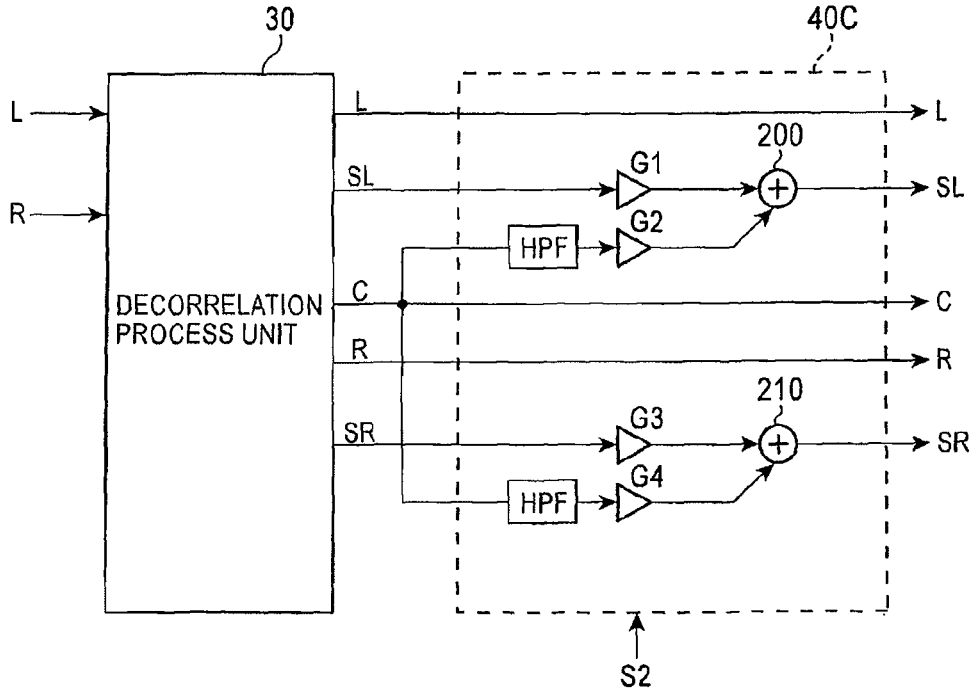
FIG. 8 is a fourth preferred example of the addition unit according to this embodiment.

FIG. 8 shows a fourth preferred example of the addition unit. In addition to the configuration shown in FIG. 7, an addition unit 40C is provided with a high-pass filter HPF for eliminating a low-frequency component from a high-correlation-component signal C. The high-pass filter HPF is preferably allowed to set the cutoff frequency to at around 200 Hz so as to eliminate low frequencies.

Figure 9:
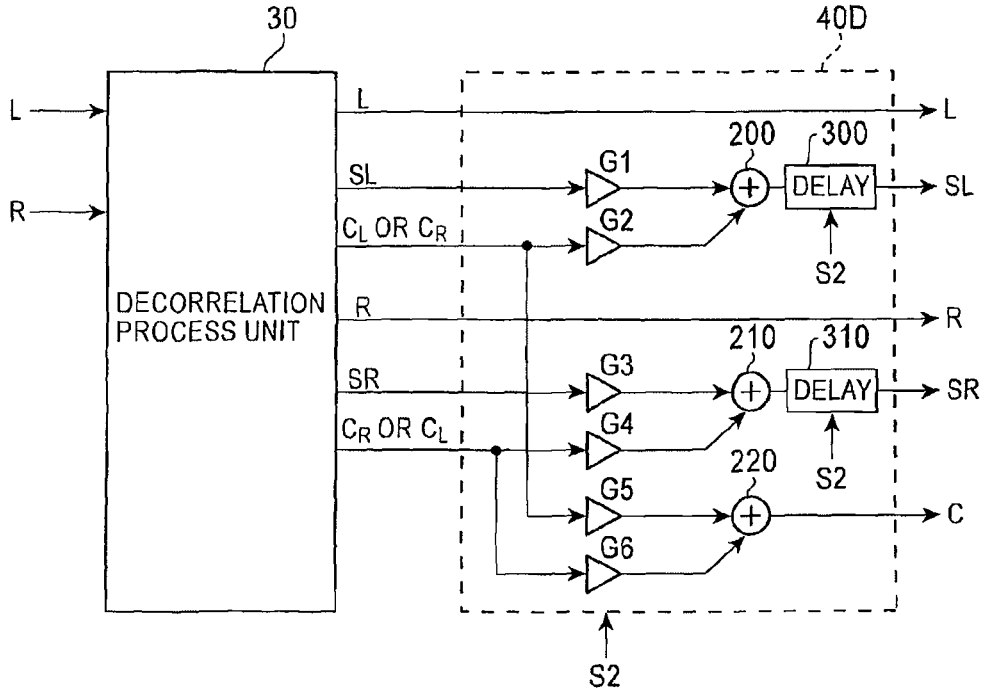
FIG. 9 is a fifth preferred example of the addition unit according to this embodiment.

As a fifth preferred example, delays are added to any one of the examples shown in FIGS. 5 to 8 so that a reduction in a sense of expansion caused by a reduction in bit rate is compensated for. An addition unit 40D shown in FIG. 9 is an example in which the delays 300 and 310 are added to the first preferred example shown in FIG. 5. The delays 300 and 310 delay the surround signals SL and SR, respectively, in accordance with the bit rate on the basis of the control signal S2 from the controller 60.

Figure 10:
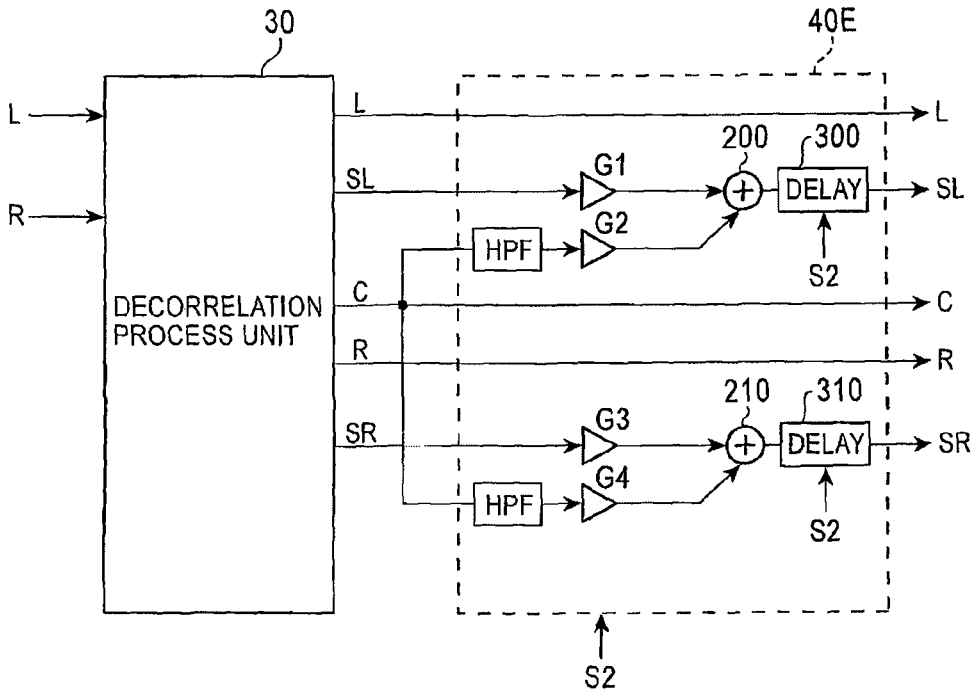
FIG. 10 is a sixth preferred example of the addition unit according to this embodiment.

An addition unit 40E shown in FIG. 10 is a sixth preferred example in which the delays 300 and 310 are added to the fourth preferred example shown in FIG. 8. As in the addition unit 40D, the delays 300 and 310 delay the surround signals SL and SR, respectively, in accordance with the bit rate on the basis of the control signal S2 from the controller 60.

Figure 11A:
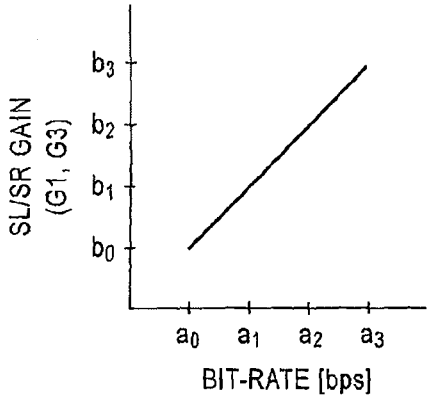
FIG. 11A shows the relations between the bit rate and addition gains G1 and G3 shown when a stereo signal is sent to the addition unit.

Next, the addition unit according to this embodiment will be described in detail. FIG. 11A shows the relations between the bit rate, and the addition gain GI of the surround signal SL and the addition gain G3 of the surround signal SR of the addition units 40 to 40E shown in FIGS. 5 to 10. The lateral axis represents the bit rate and the vertical axis represents the gain. The addition unit performs a process so that the gains G1 and G3 are made larger as the bit rate is increased. That is, when the bit rate is a0<a1<a2<a3, the gains G1 and G3 become b0<b1<b2<b3. Also, the gains G1 and G3 are preferably changed at the same time.

Figure 11B:
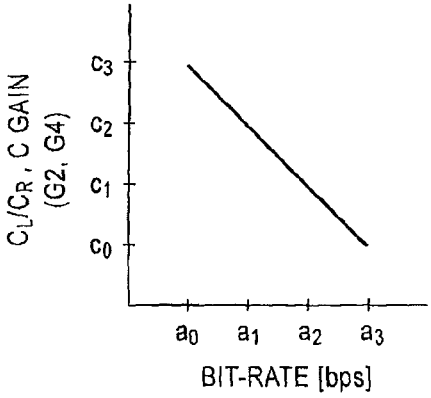
FIG. 11B shows the relations between the bit rate and addition gains G2 and G4 shown when the stereo signal is sent to the addition unit.

FIG. 11B shows the relations between the bit rate, and the addition gain G2 of the high-correlation-component signal $C_L$ and the addition gain G4 of the high-correlation-component signal $C_R$ of the addition units 40, 40A, and 40D shown in FIGS. 5, 6, and 9. The lateral axis represents the bit rate and the vertical axis represents the gain. The addition unit performs a process so that the gains G2 and G4 are made smaller as the bit rate is increased. That is, when the bit rate is a0<a1<a2<a3, the gains G2 and G4 become c3>c2>c1>c0. Also, the gains G2 and G4 are preferably changed at the same time. Note that the addition units 40B, 40C, and 40E shown in FIGS. 7, 8, and 10 replace high-correlation-component signals $C_L$ and $C_R$ with a high-correlation-component signal C.

From FIGS. 11A and 11B, the following relational expressions about the addition are obtained:

$$\text{Surround signal } SL=SL\cdot G1+C_L\cdot G2 \text{ or } SL\cdot G1+C\cdot G2$$

$$\text{Surround signal } SR=SR\cdot G3+CR\cdot G4 \text{ or } SR\cdot G3+C\cdot G4$$

$$\text{where } G1>G2,\ G3>G4,\ G1=G3, \text{ and } G2=G4$$

$$\text{Delay time [sec]}=(\text{cutoff frequency})^{-1}$$

Figure 11C:
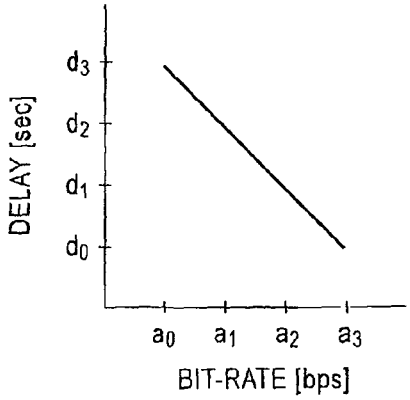
FIG. 11C shows the relations between the bit rate and delay amount shown when the stereo signal is sent to the addition unit.

FIG. 11C shows the relation between the bit rate and delay time in the delays 300 and 310 of the addition units 40D and 40E shown in FIGS. 9 and 10. The bit rate has a relation of a0<a1<a2<a3. If the bit rate is increased, the addition units 40D and 40E preferably perform a process so that the delay time is made shorter, since a sense of expansion can be ensured as is understood from FIGS. 11A and 11B. The delay time is d3>d2>d1>d0. The delays 300 and 310 preferably delay the corresponding signals at the same time. Also, the addition units 40D and 40E may each change the delay amount in accordance with the addition amount of the high-correlation-component signal C or the cutoff frequency of the HPF.

Figure 12A:
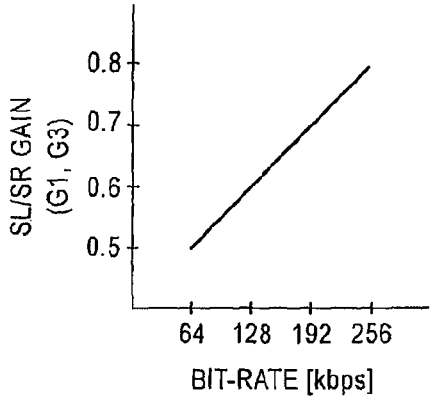
FIGS. 12A to 12C are graphs showing an example of a specific numerical value with respect to the addition unit.
Figure 12B:
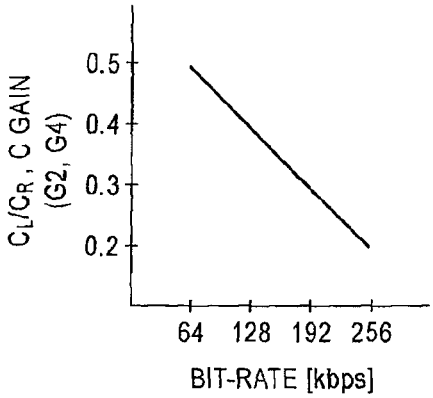
Figure 12C:
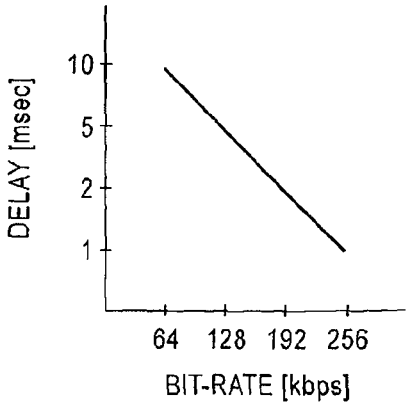

Next, an example of a specific numerical value with respect to the addition unit will be described. FIGS. 12A to 12C show the relations between the bit rate and gains G1 and G3, the relations between the bit rate and gains G2 and G4, and the relation between the bit rate and delay time shown in a case where a signal compressed and decompressed using the stereo method is passed through the correlation elimination process unit 30 and then sent to the addition unit. FIGS. 12A to 12C correspond to FIGS. 11A to 11C, respectively. The bit rate of the lateral axis is set to 64, 128, 192, and 256 kbps, and the addition gain of the vertical axis is set within a range from the minimum of 0 to the maximum of 1.

Here, it is assumed that, for example, by setting G1 and G3 to 0.5 and setting G2 and G4 to 0.5 when the bit rate is 64 kbps, as shown in FIG. 12A, artifacts are eliminated due to a masking effect. Incidentally, the addition of a high-correlation-component signal C or high-correlation-component signals $C_L$ and $C_R$ may increase the cross-correlation coefficient between the surround signals SL and SR. In this case, by increasing the delay, for example, to 10 ms (cutoff frequency of 100 Hz), a surround sound providing a sense of expansion can be realized.

Also, by setting G1 and G3 to 0.8 and setting G2 and G4 to 0.2 when the bit rate is changed to 256 kbps, the addition amount of a high-correlation component is reduced. Thus, the cross-correlation coefficient becomes a smaller value. This is enough. If it is desired to obtain a more expansion sense, a delay of, e.g., 1 ms is preferably added (the cutoff frequency is set to 1 kHz and then sounds of 1 kHz or more will be subjects).

Figure 13A:
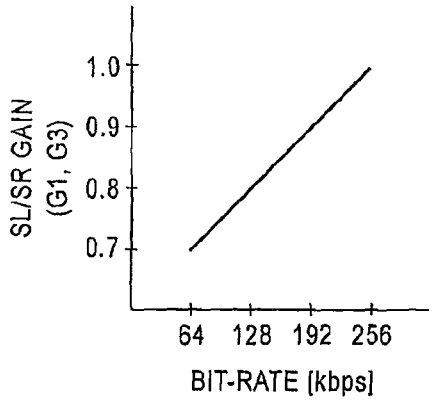
FIG. 13A shows the relations between the bit rate and gains G1 and G3 shown when a joint-stereo signal is sent to the addition unit.
Figure 13B:
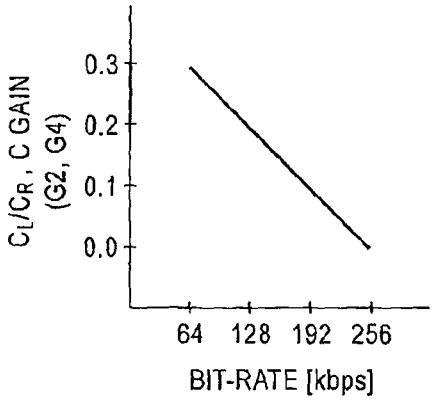
FIG. 13B shows the relations between the bit rate and gains G2 and G4 shown when the joint-stereo signal is sent to the addition unit.
Figure 13C:
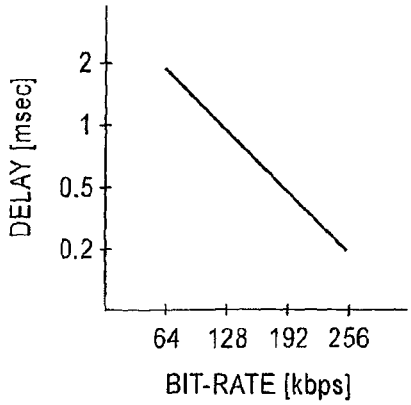
FIG. 13C shows the relations between the bit rate and delay amount shown when the joint-stereo signal is sent to the addition unit.

FIGS. 13A to 13C show the relations between the bit rate and gains G1 and G3, the relations between the bit rate and gains G2 and G4, and the relation between the bit rate and delay time, respectively, in a case where a signal compressed and decompressed using the joint stereo method is passed through the decorrelation unit 30 and then sent to the addition unit 40. Even use of the joint stereo method is not without artifacts and artifacts occurs in a slight amount. Therefore, it is preferable to reduce the addition amount of a high-correlation-component signal C or high-correlation-component signals $C_L$ and $C_R$ than that in a case where the stereo method is used and increase the addition amount of the surround signals SL and SR than that in a case where the stereo method is used.

Figure 14:
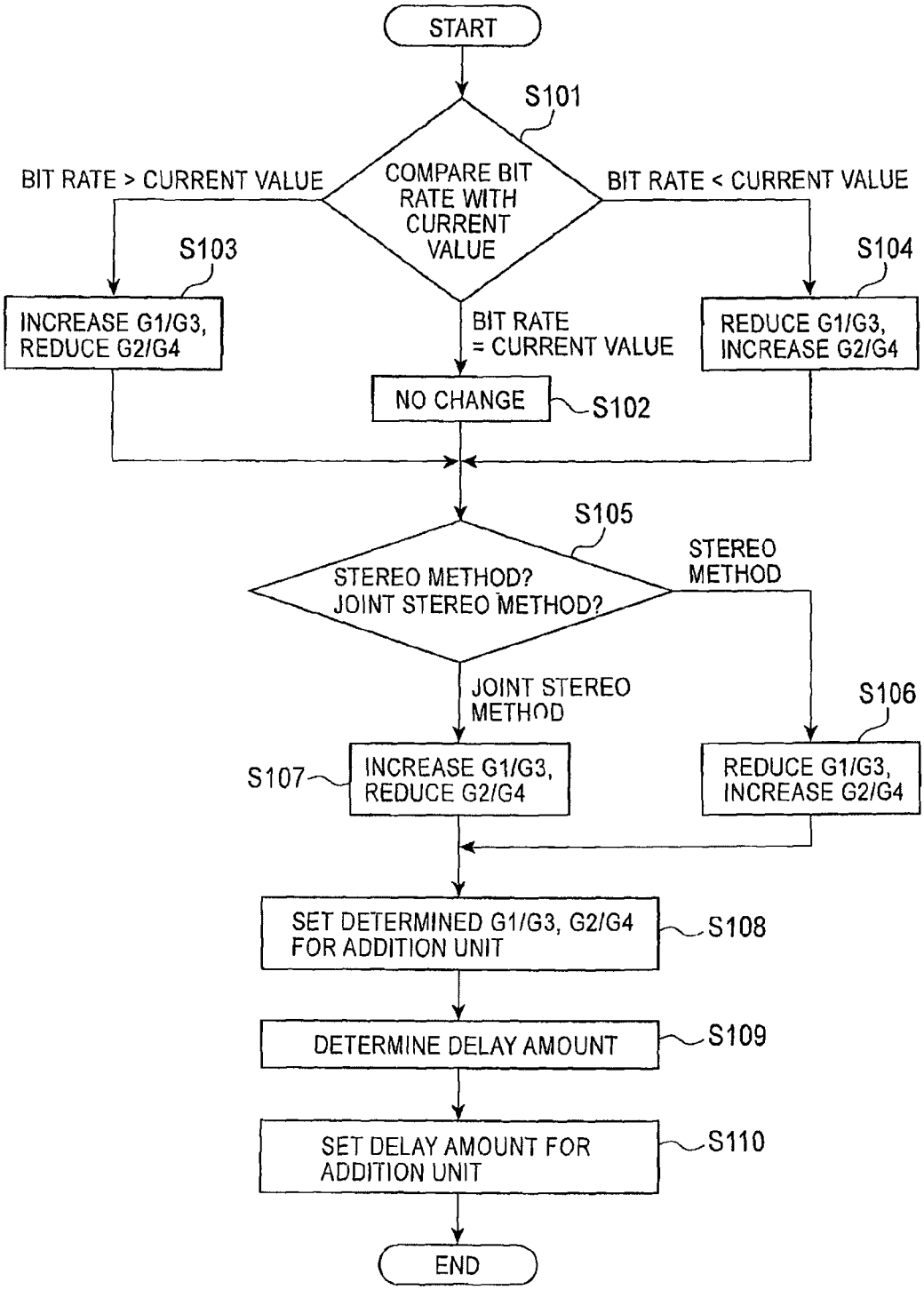
FIG. 14 is a flowchart showing an addition process control operation performed by a controller according to this embodiment.

FIG. 14 is a flowchart showing an example of an addition control operation performed by the controller. The controller 60 refers to the coding information H to compare the bit rate of the received audio data stream $D_1$ with the current bit rate (step S101). If the bit rate is equal to the current bit rate, the controller 60 determines that it will not change the addition process (step S102). If the bit rate is larger than the current bit rate, the controller 60 determines that it will increase the gains G1 and G3 of the surround signals and reduce the gains G2 and G4 of the high-correlation-component signals (step S103). If the bit rate is smaller than the current bit rate, the controller 60 determines that it will reduce the gains G1 and G3 of the surround signals and increase the gains G2 and G4 of the high-correlation-component signals (step S104).

Subsequently, the controller 60 determines whether the received audio data stream $D_1$ is coded using the stereo method or the joint stereo method (step S105). If it is determined that the stereo method is used, the controller 60 determines that it will reduce the gains G1 and G3 of the surround signals and increase the gains G2 and G4 of the high-correlation-component signals (step S106). If it is determined that the joint stereo method is used, the controller 60 determines that it will increase the gains G1 and G3 of the surround signals and reduce the gains G2 and G4 of the high-correlation-component signals (step S107).

The controller 60 sets the determined gains G1 and G3 and gains G2 and G4 for the addition unit via the control signal S2 (step S108). Subsequently, the controller 60 determines the delay amount on the basis of the bit rate and on the basis of which of the stereo method and joint stereo method is used (step S109) and sets the determined delay amount for the addition unit via the control signal S2 (step S110).

Figure 15:
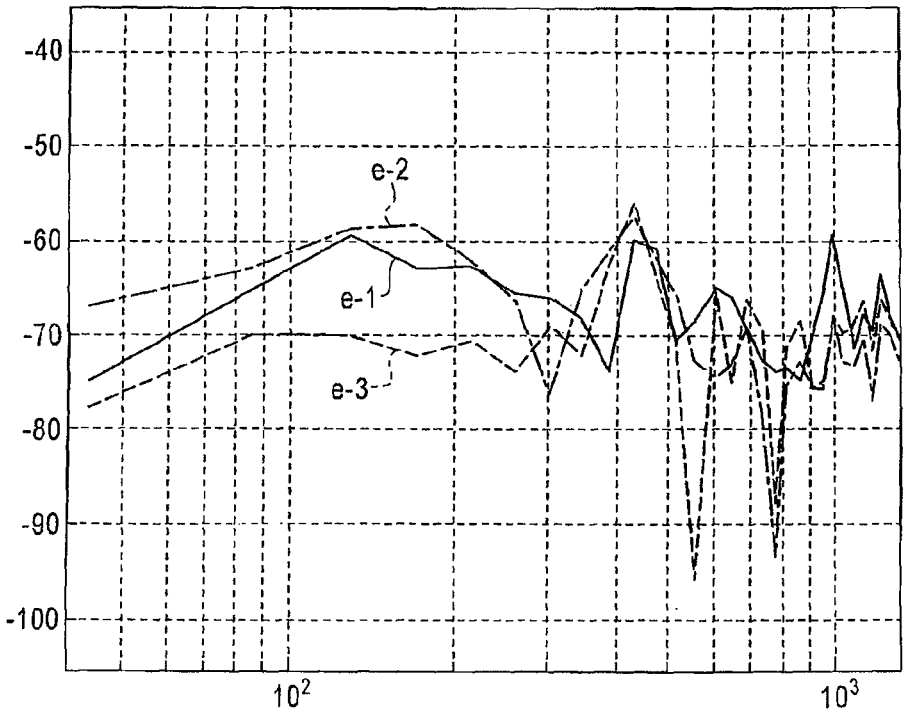
FIG. 15 is a graph showing a frequency characteristic of a surround signal SL processed by the addition unit according to this embodiment shown in FIG. 5.
Figure 21:
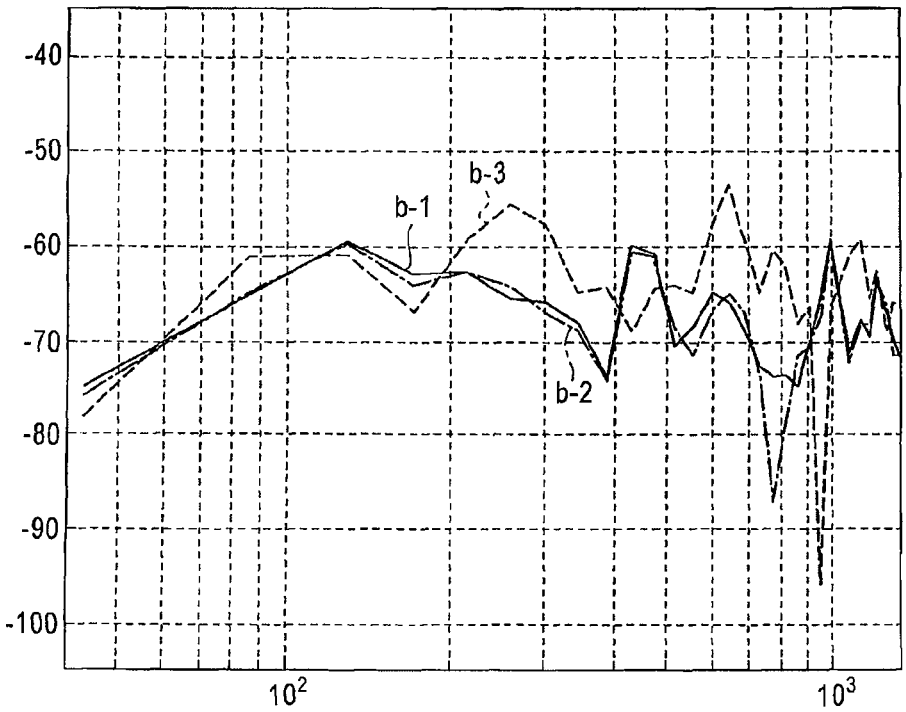
FIG. 21 is a graph showing a frequency characteristic of a surround signal having a low-correlation component extracted in a related-art decorrelation process shown in FIG. 18.
Figure 22:
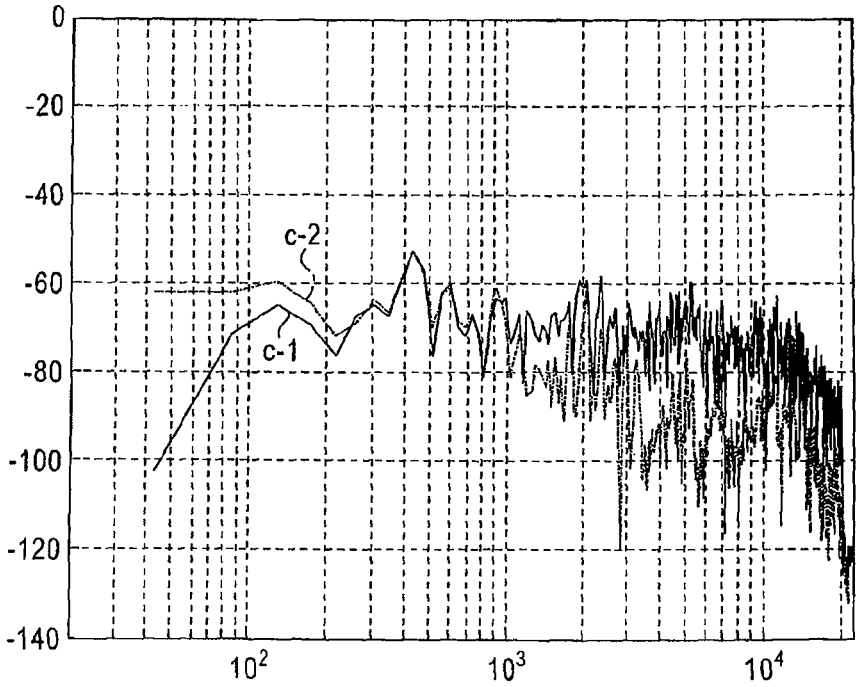
FIG. 22 is a graph showing a comparison between a result of a surround algorithm based on stereo signals L-R and R-L and a stereo method.
Figure 23:
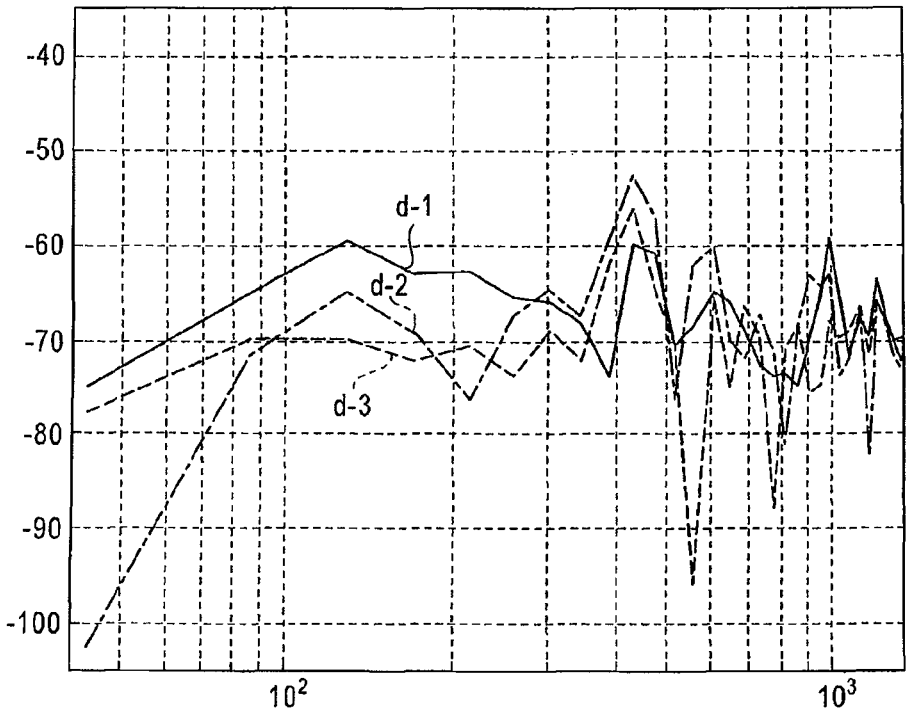
FIG. 23 is a graph showing a frequency characteristic of a surround signal having a low-correlation component extracted in the related-art decorrelation process shown in FIG. 18.

Next, advantages of this embodiment will be described. FIG. 15 is a graph showing a frequency characteristic of the surround signal SL shown when a calculation process is performed by the addition unit according to this embodiment shown in FIG. 5. The observation sections are the same as those shown in FIG. 21.

In FIG. 15, e-1 shows a characteristic of the surround signal SL using a linear PCM (pulse code modulation) signal as an input (same as b-1). e-2 shows a characteristic of the surround signal SL generated after a signal coded using AAC (advanced audio coding) format and the stereo method and having a bit rate of 128 kbps is processed by the decorrelation unit 30 and then the addition unit 40 shown in FIG. 5. In this case, G1 is 0.5, G2 is 0.5, G3 is 0.5, and G4 is 0.5. e-3 shows a characteristic of the surround signal SL generated immediately after a signal coded using AAC format and the stereo method and having a bit rate of 128 kbps is processed by the decorrelation unit 30 shown in FIG. 5.

Pay attention to a frequency range from 200 Hz to 1 kHz in FIG. 15, which is taken as a problem and contains a large amount of information. From the graph, it is understood that the characteristic of e-1 has been made similar to the characteristic of the non-compressed linear PCM (e-1) and that audible artifacts have been reduced due to a masking effect. It is estimated that a dip around 800 Hz is a location that cannot be recovered in terms of the compression principles.

Taking into account the above-mentioned advantage, for example, the addition unit 40A according to this embodiment shown in FIG. 6, which is as a derivative of the FIG. 5, is configured so that it passes, through the HPF, the high-correlation-component signal $C_L$ sent from the decorrelation unit 30 and then adds the high-correlation-component signal $C_L$ to the surround signal L. It is known that low-frequency signals are signals having a high correlation between the stereo signals L and R. For this reason, if it is of importance to obtain a sense of expansion, it is preferable to design an HPF having, as the cutoff frequency, a frequency of, e.g., around 200 Hz or more where an artifact is apt to occur while avoiding a frequency range where there is a high correlation, pass a high correlation component signal $C_L$ through the HPF, and then add the high correlation component signal $C_L$ to the surround signal SL. Thus, artifacts can be eliminated. Also, it is preferable that the cutoff frequency be variable, since the cutoff frequency is influenced by the bit rate, albeit in a tiny range.

Also in the configuration shown in FIG. 9, which is another derivative of the configuration according to this embodiment shown in FIG. 5, the number of artifacts is increased as the bit rate is lowered, and thus if the addition ratio is increased, more high-correlation components are added. Therefore, by additionally providing the delays 300 and 310 in the addition unit 40D, the correlation is reduced. A method by which the correlation is reduced by additionally providing delays is well known. For example, if the cutoff frequency is 200 Hz and the sampling frequency is 44100 Hz for 5 ms, it is preferable to have a delay amount of 221 samples. While no HPF is shown in the configuration shown in FIG. 9, an HPF may be provided in the addition unit 40D located after the decorrelation unit 30 so that the delay amount is changed in accordance with a change in cutoff frequency of the HPF. For example, if the cut off frequency is 200 Hz, it is preferable to ensure at least 5 ms (or more) using the delays 300 and 310. Also, if the cut off frequency is 500 Hz, it is preferable to ensure at least 2 ms (or more) using the delays 300 and 310.

Figure 16:
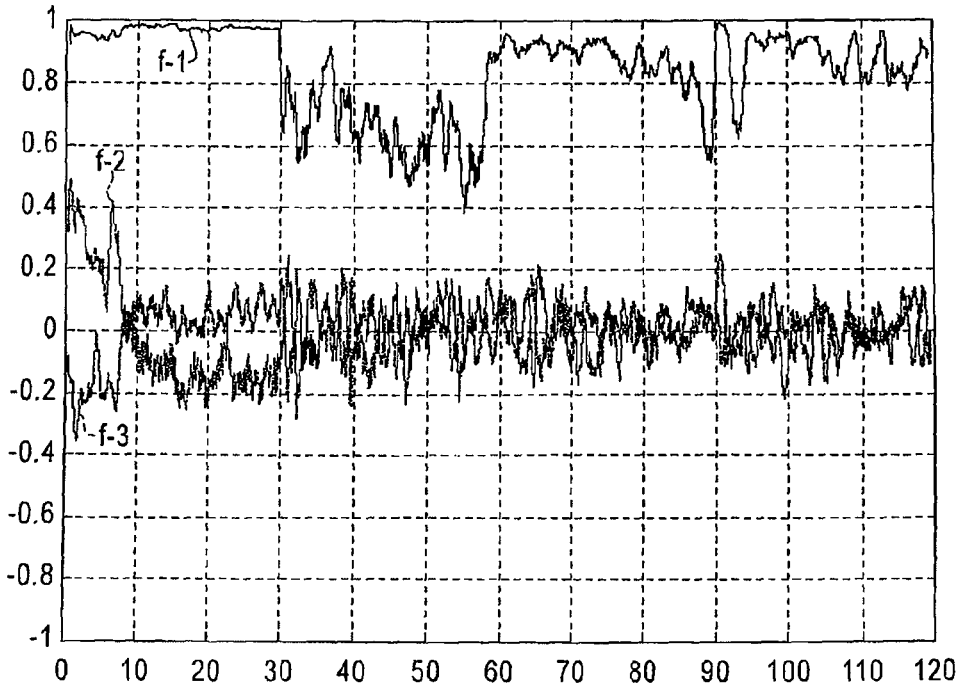
FIG. 16 shows a distribution of a cross-correlation coefficient processed by the addition unit according to this embodiment shown in FIG. 9.
Figure 20:
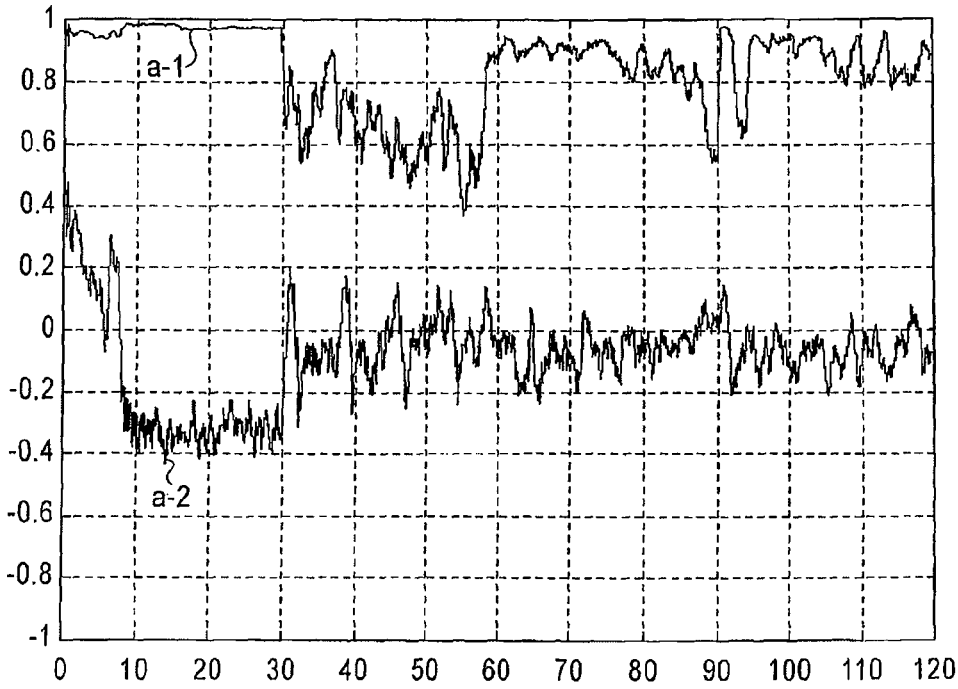
FIG. 20 is a graph showing a distribution of a cross-correlation coefficient shown when a piece of music is observed for two minutes.

FIG. 16 shows a distribution of a cross-correlation coefficient shown when a calculation process is performed in the configuration according to this embodiment shown in FIG. 9. The observation method is the same as that used in FIG. 20. In FIG. 16, f-1 shows a distribution of a cross-correlation coefficient between the stereo signals L and R coded using AAC format and the stereo method and having a bit rate of 128 kbps. f-2 shows a distribution of a cross-correlation coefficient between the stereo signal L and surround signal SR sent after a signal coded using AAC format and the stereo method and having a bit rate of 128 kbps is processed by the decorrelation unit 30 and addition unit 40D shown in FIG. 9. In this case, the delays 300 and 310 are both zero. Also, G1 is 0.6, G2 is 0.4, G3=0.6, and G4 is 0.4. f-3 shows a cross-correlation coefficient distribution between the stereo signal L and surround signal SR shown sent after a signal coded using AAC format and the stereo method and having a bit rate of 128 kbps is processed by the decorrelation unit 30 and addition unit 40D shown in FIG. 9. In this case, the delays 300 and 310 are both 221 (it is assumed that the cut off frequency is 200 Hz and the sampling frequency is 44100 Hz for 5 ms). Also, G1 is 0.6, G2 is 0.4, G3=0.6, and G4 is 0.4. From the plot of f-3, it is understood that if a delay is added, the cross-correlation coefficient has been stable in a range from 0 to ±0.2 around an area from 10 to 30 sec. where the number of artifacts is particularly large. This is advantageous in that a listener can obtain a more sense of expansion.

Figure 17:
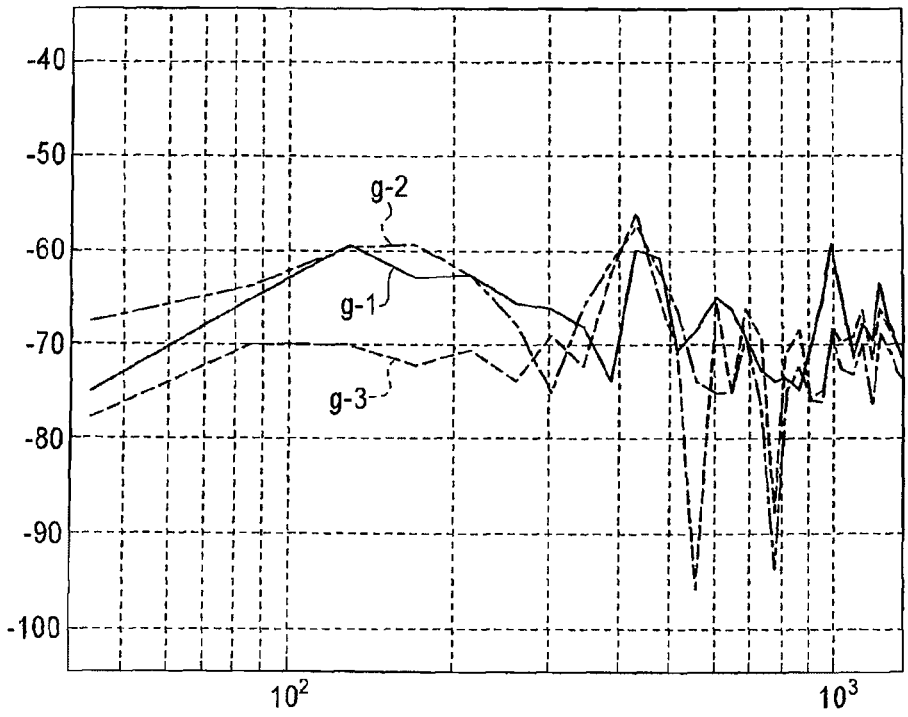
FIG. 17 is a graph showing a frequency characteristic of a surround signal SL processed by the addition unit according to this embodiment shown in FIG. 7.

FIG. 17 is a graph showing a frequency characteristic of the surround signal SL shown when a calculation process is performed in the configuration according to this embodiment shown in FIG. 7. The observation sections are the same as those shown in FIG. 21. In FIG. 17, g-1 shows a characteristic of the surround signal SL using a linear PCM signal as an input (same as b-1). g-2 shows a characteristic of the surround signal SL produced after a signal coded using AAC format and the stereo method and having a bit rate of 128 kbps is processed by the decorrelation unit 30 and addition unit 40 shown in FIG. 5. In this case, G1 is 0.5, G2 is 0.5, G3 is 0.5, and G4 is 0.5. g-3 shows a characteristic of the surround signal SL produced immediately after a signal coded using AAC format and the stereo method and having a bit rate of 128 kbps is processed by the decorrelation unit 30 shown in FIG. 5.

Also from FIG. 17, it is understood that the characteristic of g-2 has been made similar to that of the characteristic of the non-compressed linear PCM represented by e-1 by performing an addition process and that the number of audible artifacts has also been reduced due to a masking effect. The configurations shown in FIGS. 8 and 10 are also derived from the configuration shown in FIG. 5 on the basis of the above-mentioned idea except that the outputs of the decorrelation unit 30 are changed from the high-correlation-component signals $C_L$ and $C_R$ to the high-correlation-component signals C.

While the preferred embodiment of the present invention has been described in detail, the invention is not limited to such a specific embodiment and various modifications and changes can be made thereto without departing from the spirit and scope of the invention as set forth in the appended claims. While an example where surround signal are generated from stereo signals is shown in the above-mentioned embodiment, surround signals may be generated from other stereo signals and played back, as a matter of course. It will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. A surround generation apparatus for generating a multichannel surround signal from an encoded audio stream, the surround generation apparatus comprising:

a decoder configured to decode the encoded audio stream and determine a coding method used to encode the encoded audio stream;

a decorrelation unit configured to receive at least two stereo signals decoded by the decoder and decorrelate the at least two stereo signals so as to generate a surround signal having a low-correlation component;

an addition unit configured to add, to the surround signal, a high-correlation-component signal extracted from the at least two stereo signals, wherein the addition unit adds, to the surround signal, a signal obtained by eliminating a low-frequency component from the high-correlation-component signal; and a controller configured to control addition of the high-correlation-component signal performed by the addition unit based at least in part on the coding method used to encode the encoded audio stream as determined by the decoder, wherein the controller controls the addition of the high-correlation-component signal performed by the addition unit such that quality of a surround sound generated by the apparatus is enhanced.

2. The surround generation apparatus according to claim 1, wherein the decorrelation unit extracts, from a first stereo signal of the at least two stereo signals, the high-correlation-component signal having a high correlation with a second stereo signal of the at least two stereo signals, and generates the surround signal having the low-correlation component, the surround signal generated based on a difference between the high-correlation-component signal extracted by the decorrelation unit and the second stereo signal, and the addition unit adds the high-correlation-component signal extracted by the decorrelation unit to the surround signal.

3. The surround generation apparatus according to claim 1, wherein the decorrelation unit includes:

a surround signal SL generation unit configured to:

extract, from a stereo signal R of the at least two stereo signals, a high-correlation-component signal $C_L$, the high-correlation-component signal $C_L$ having a high correlation with a stereo signal L of the at least two stereo signals, and generate a surround signal SL having a first low-correlation component, the surround signal SL generated based on a difference between the high-correlation-component signal $C_L$ and the stereo signal L; and a surround signal SR generation unit configured to:

extract, from the stereo signal L, a high-correlation-component signal $C_R$, the high-correlation-component signal $C_R$ having a high correlation with the stereo signal R, and generate a surround signal SR having a second low-correlation component, the surround signal SR generated based on a difference between the high-correlation-component signal $C_R$ and the stereo signal R, and wherein the addition unit adds (a) the high-correlation-component signal $C_L$ to the surround signal SL, and (b) the high-correlation-component signal $C_R$ to the surround signal SR.

4. The surround generation apparatus according to claim 1, wherein the decorrelation unit includes:

a surround signal SL generation unit configured to extract, from a stereo signal R of the at least two stereo signals, a high-correlation-component signal $C_L$ having a high correlation with a stereo signal L of the at least two stereo signals, and generate a decorrelated surround signal SL from a difference between the high-correlation-component signal $C_L$ and the stereo signal L; and a surround signal SR generation unit configured to extract, from the stereo signal L, a high-correlation-component signal $C_R$ having a high correlation with the stereo signal R and generate a decorrelated surround signal SR from a difference between the high-correlation-component signal $C_R$ and the stereo signal R, and wherein the addition unit adds a high-correlation-component signal C including the high-correlation-component signal $C_L$ and the high-correlation-component signal $C_R$ to each of the surround signal SL and the surround signal SR.

5. The surround generation apparatus according to claim 4, wherein the high-correlation-component signal C includes the high-correlation-component signal $C_L$ and the high-correlation-component signal $C_R$ equally.

6. The surround generation apparatus according to claim 1, wherein when a coding bit rate of the at least two stereo signals is a first bit rate, the controller controls the addition unit so that the high-correlation-component signal is added at a first rate, and when the coding bit rate of the at least two stereo signals is a second bit rate that is higher than the first bit rate, the controller controls the addition unit so that the high-correlation-component signal is added at a second rate lower than the first rate.

7. The surround generation apparatus according to claim 1, wherein when a coding method of the at least two stereo signals is a first coding method, the controller controls the addition unit so that the high-correlation-component signal is added at a first rate, and when the coding method of the at least two stereo signals is a second coding method, the controller controls the addition unit so that the high-correlation-component signal is added at a second rate lower than the first rate.

8. The surround generation apparatus according to claim 7, wherein the first coding method is stereo coding by which a stereo signal L of the at least two stereo signals and a stereo signal R of the at least two stereo signals are coded independently, and the second coding method is joint stereo coding by which parts of the stereo signal L and the stereo signal R, the parts having a high correlation, are coded jointly.

9. A surround system comprising:

the surround generation apparatus according to claim 1; and a plurality of speakers configured to generate a stereo signal L, a stereo signal R, a surround signal SL, a surround signal SR, and a center signal C.

10. The surround system according to claim 9, wherein the speakers are mounted inside a vehicle.

11. A surround generation apparatus for generating a multichannel surround signal from an encoded audio signal, the surround generation apparatus comprising:

a decoder configured to decode the encoded audio signal and determine a coding method used to encode the encoded audio stream;

a surround signal generation unit configured to:

receive stereo signals L and R decoded by the decoder, extract, from the stereo signal R, a high-correlation-component signal $C_L$ having a high correlation with a stereo signal L, generate a surround signal SL having a first low-correlation component, the surround signal SL generated based on a difference between the high-correlation-component signal $C_L$ and the stereo signal L, extract, from the stereo signal L, a high-correlation-component signal $C_R$ having a high correlation with the stereo signal R, and generate a surround signal SR having a second low-correlation component, the surround signal SR generated based on a difference between the high-correlation-component signal $C_R$ and the stereo signal R;

an addition unit configured to add a signal including at least one of the high-correlation-component signal $C_L$ and the high-correlation-component signal $C_R$ to the surround signal SL and configured to add a signal including at least one of the high-correlation-component signal $C_L$ and the high-correlation-component signal $C_R$ to the surround signal SR; and a controller configured to control an addition ratio of the high-correlation-component signal added by the addition unit based at least in part on the coding method used to encode the encoded audio stream as determined by the decoder, wherein the controller controls the addition ratio of the high-correlation component signal performed by the addition unit such that quality of a surround sound generated by the apparatus is enhanced;

wherein the signal that the addition unit adds to the surround signal SL is obtained by eliminating a low frequency component from the at least one of the high-correlation-component signal $C_L$ and the high-correlation-component signal $C_R$ and wherein the signal that the addition unit adds to the surround signal SR is obtained by eliminating a low frequency component from the at least one of the high-correlation-component signal $C_L$ and the high-correlation-component signal $C_R$.

12. The surround generation apparatus according to claim 11, wherein the controller controls the addition unit so that a mixing ratio of the high-correlation-component signal is increased as a coding bit rate is lowered and so that a mixing ratio of the first or second low-correlation component of the surround signal is increased as the coding bit rate is increased.

13. The surround generation apparatus according to claim 11, wherein the controller controls an addition ratio of the high-correlation-component signal added by the addition unit on the basis of a coding method of the stereo signal.

14. The surround generation apparatus according to claim 13, wherein the controller controls the addition unit so that the mixing ratio of the high-correlation-component signal is reduced when joint stereo coding is used.

* * * * *